United States Patent [19]

Bran

[11] Patent Number: 4,804,007

[45] Date of Patent: Feb. 14, 1989

[54] CLEANING APPARATUS

[75] Inventor: Mario E. Bran, Garden Grove, Calif.

[73] Assignee: Verteq, Inc., Anaheim, Calif.

[21] Appl. No.: 43,852

[22] Filed: Apr. 29, 1987

[51] Int. Cl.[4] ..... B08B 3/10

[52] U.S. Cl. ..... 134/184; 134/201; 310/334

[58] Field of Search ..... 134/1, 184, 201; 68/3 SS; 366/127; 310/322, 323, 324, 334, 340

[56] References Cited

U.S. PATENT DOCUMENTS

| | | | |
|---|---|---|---|
| 2,950,725 | 8/1960 | Jacke et al. | 134/1 X |
| 3,058,014 | 10/1962 | Camp | 134/1 X |
| 3,301,535 | 1/1967 | Brown | 366/127 X |
| 3,396,286 | 8/1968 | Anderson et al. | 134/1 X |
| 3,415,548 | 12/1968 | Goodman et al. | 68/3 SS X |
| 3,873,071 | 3/1975 | Tatabe | 134/184 X |
| 3,893,869 | 7/1975 | Mayer et al. . | |
| 4,099,417 | 7/1978 | Shwartzman . | |
| 4,118,649 | 10/1978 | Shwartzman et al. . | |
| 4,326,553 | 4/1982 | Hall . | |
| 4,602,184 | 7/1986 | Meitzler . | |

*Primary Examiner*—Harvey C. Hornsby
*Assistant Examiner*—Frankie L. Stinson
*Attorney, Agent, or Firm*—Knobbe, Martens, Olson & Bear

[57] ABSTRACT

A transducer array for use in a megasonic cleaning system comprising a flat plate made of quartz or sapphire or boron nitride and a transducer having a conductive flat surface bonded to the flat plate and a conductive surface spaced from the flat plate.

12 Claims, 1 Drawing Sheet

10
12
14
16
18
20
22
24
26
28
30
32
34
36
38
42
44
46
48
50
51
54
58
60
5
6

CLEANING APPARATUS

FIELD OF THE INVENTION

This invention relates to apparatus for cleaning semiconductor wafers or other such items requiring extremely high levels of cleanliness.

BACKGROUND OF THE INVENTION

U.S. Pat. No. 3,893,869, assigned to RCA, discloses a cleaning system wherein very high frequency energy is employed to agitate a cleaning solution to loosen particles on the surfaces of semiconductor wafers. Maximum cleanliness for such items is desired in order to improve the yield of acceptable semiconductor chips made from such wafers. This cleaning, system has become known as megasonic cleaning, in contrast to ultrasonic cleaning in view of the high frequency energy employed. Ultrasonic cleaners generate random 20–40 kHz sonic waves that create tiny cavities in a cleaning solution. When these cavities implode, tremendous pressures are produced which can damage fragile substrates, especially wafers. Megasonic cleaning systems typically operate at a frequency over 20 times higher than ultrasonics, and consequently, they safely and effectively remove particles from materials without the side effects associated with ultrasonic cleaning.

A number of improvements have been made to the system as initially outlined in the above-referenced patent, and several companies are now marketing such cleaning apparatus. One of these is Verteq, Inc. of Anaheim, Calif., the assignee of the invention disclosed and claimed in this document.

One of the major improvements that helped make the Product a commercial reality concerns the design of the transducer array which converts electrical energy into sound waves for agitating the cleaning liquid. The transducer array is perhaps the most critical component of the megasonic cleaning system. The transducer array which has been developed over a number of years and is currently being marketed by Verteq is mounted on the bottom of the process tank close to the components to be cleaned so as to provide powerful particle removal capability. The transducer array includes a strong, rigid frame suitable for its environment, with a very thin layer of tantalum, which is a ductile acid-resisting metallic element, spread over the upper surface of the frame.

A pair of spaced rectangular ceramic transducers are positioned within a space in the plastic frame and bonded by electrically conductive epoxy to the lower side of the tantalum layer extending over the space in the frame. The transducer has a coating of silver on its upper and lower faces that form electrodes. RF (radio frequency) energy approximately 800 kHz is applied to the transducer by connecting one lead to the lower face of the transducer and by connecting the other lead to the layer of tantalum which is electrically conductive and which is in electrical contact with the upper silver coating of the transducer.

While megasonic cleaning systems employing this transducer array have enjoyed commercial success, improvements are needed. Foremost, it is highly desirable that the life of the transducer array be extended so as to reduce the cost of repair and replacement, and more importantly, to avoid interruptions in the processing of components by such cleaning apparatus. The cost of the overall system, which includes equipment for handling the cleaning solutions and further includes computerized controls, may exceed $25,000. Accordingly, it is not practical for users to keep an entire spare system, and a repair or replacement capability is not always readily available when needed.

Perhaps the most frequent failure in the transducer array concerns the bonding between the layer of tantalum and the upper silver coating on the transducers. Over a period of time, the vibration of the components will result in small bubbles or spaces in the epoxy bonding layer between the transducer and the tantalum sheet. Heat produced by the high energy is not as readily conducted away from these minute spaces as it is in the surrounding interconnection, with the result that hot spots eventually occur causing the bonding agent to further break down. Such heat eventually damages the thin tantalum layer. Moreover, as the hot spots increase in number and size, the effectiveness of the focused energy provided by the transducer array gradually declines such that the cleaning operation is less effective. Because of the hot spot problem, great care is taken in bonding the thin tantalum sheet to its support structure; however, this is a difficult task resulting in low productivity. After the bonding operation, small bubbles or imperfections can actually be felt by hand through the tantalum layer. If these are detected, the product is scrapped.

A number of efforts have been previously made to improve this situation. One company has greatly increased the thickness of the tantalum layer, apparently on the expectation that the greater thickness would better dissipate the heat build-up of hot spots, if they should start to occur. Further, a thicker layer adds structural strength to the assembly, which would help overcome an additional problem of the existing arrays concerning their durability. However, in addition to increasing the cost the thicker layer of tantalum does not appear to transmit the megasonic energy as effectively as the thin layer.

Another attempted approach was to use vitreous carbon instead of the thin layer of tantalum, in that such material is also electrically conductive and can withstand acid and other cleaning solutions, being particularly durable and hard. However, this approach was not successful due to the difficulty of fabricating vitreous carbon in a thin, smooth plate-like layer, as is done with tantalum.

Stainless steel has been used as an energy transmitting element with transducers being bonded to it, but it is not nearly as good as tantalum with regard to chemical inertness and contaminates, and with regard to mechanical erosion or stability.

It was also believed that the material should be electrically-conductive so as to facilitate electrical connection to the transducer conductive layer to which it is bonded. This requirement, of course, eliminated many materials from consideration.

The need for an improved solution to this problem of increasing the life of the transducer array has thus continued, and it is an object of the present invention to provide such an improvement.

SUMMARY OF THE INVENTION

Briefly stated, the invention comprises a megasonic cleaning system utilizing a transducer array which in one form of the invention employs a quartz plate connected to one or more transducers to transmit megasonic energy into the cleaning solution. It was discovered that a quartz plate will properly resonate and transmit the megasonic energy when a flat, elongated ceramic transducer is bonded to one face of the quartz plate by a thin layer of epoxy, which need not be electrically conductive. Due to the hardness and smoothness of the mating surfaces, the layer of epoxy is smooth and even, thus minimizing the likelihood of bubbles or air pockets remaining in the layer. Also, less skill is required to bond to thick quartz then to thin tantalum. Further, the thickness of the plate provides strength and durability.

The quartz plate is mounted on a frame in a liquid-tight manner, so that quartz thus forms the upper surface of the transducer array, which is exposed to cleaning solutions, while the transducer is located on the lower side away from the cleaning solutions. Electrical connections are made to the transducer, with one conductor connected to the lower electrically conductive surface on the transducer and the other conductor being connected to a conductive layer on the end of the transducer which is a continuation of the conductive surface on the upper side of the transducer that is bonded to the quartz plate.

Preferably, the thickness of the quartz plate is in a range of 0.030 to 0.300 inch thick, and particularly a preferred thickness of about 0.080 inch. Adequate megasonic cleaning requires a minimum of 20 watts of RF power per square inch of the transmitting surface, and preferably provides about 25 watt density. The voltage and frequency required varies with the thickness of the quartz plate. In the thickness range mentioned, the frequency need is in the range of 300 to 3000 kHz for an acceptable system.

One of the severe limiting factors in the choice of material bonded to the transducers is the nature of the cleaning solutions to which the material is exposed during use. One solution, identified in the trade as "SC-1," contains hydrogen peroxide, ammonia and deionized water. Another, referred to as "SC-2," is the same as SC-1 except it has hydrochloric acid instead of ammonia. Thus, it reacts with metallic ions and produces contaminates. Another solution, known in the trade as Caros or Pirahna, contains sulfuric acid, and hence, it eliminates many materials as choices to replace tantalum.

Utilizing a quartz plate is satisfactory for many cleaning solutions, however, since quartz can be etched by some solutions such as solutions containing hydrofluoric acid, it is not suitable with such materials. Thus, in another form of the invention, a sapphire plate is employed instead of quartz. Preferably, the sapphire plate is in a range of 0.030 to 0.300 inch thick and, most preferably, about 0.060 inch. Plates of that thickness are sufficiently sturdy and will resonate and properly transmit the megasonic energy of various frequencies. The transducer itself is bonded to the sapphire plate in the same manner as with the quartz plate, and the electrical connections are likewise similarly made.

The plate may also be formed of other dielectric, inorganic, relatively inert, non-contaminating materials having characteristics similar to quartz and sapphire. Boron nitride is another satisfactory material.

In accordance with the method of the invention, megasonic energy is transmitted to a cleaning solution by bonding a transducer to a plate made of quartz or sapphire or other plate having similar characteristics, mounting the plate in the wall of a container for the cleaning solution, with the plate facing the cleaning solution, and applying megasonic electrical energy to the transducer.

DETAILED DESCRIPTION OF THE DRAWINGS

Figures 1, 2, 3, 4, 5, 6:
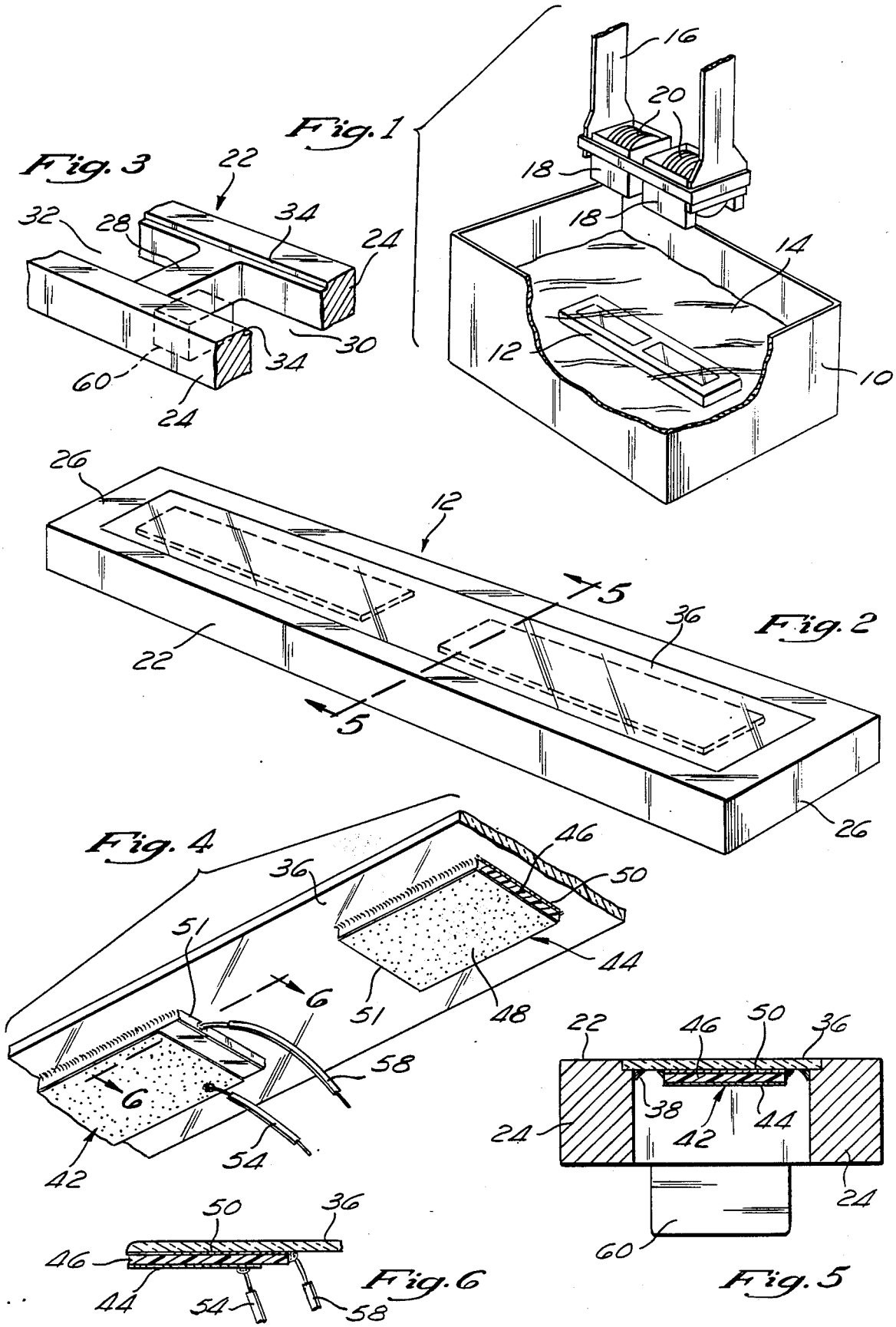
FIG. 1 is a schematic perspective view of the cleaning apparatus of the invention.
FIG. 2 is an enlarged perspective view of the transducer array of the cleaning apparatus of FIG. 1.
FIG. 3 is an enlarged perspective view of a portion of the transducer array of FIG. 2.
FIG. 4 is an enlarged perspective view of a portion of the transducers and the mounting plates taken from below the transducer array.
FIG. 5 is a cross-sectional view of the transducer array on line 5—5 of FIG. 2.
FIG. 6 is a cross-sectional view of a transducer and a transducer mounting plate illustrating the electrical connection for the transducer.

FIG. 1 schematically illustrates a container 10 as a portion of a megasonic cleaning system. A transducer array 12 is mounted in the bottom wall of the container 10. Cleaning solution 14 is positioned in the container above the upper surface of the transducer array 12. A cassette holder 16 is schematically illustrated above the container, with the holder supporting a pair of cassettes 18 carrying semiconductor wafers 20.

The details of the container and the holder are not needed for an understanding of the present invention, which concerns the transducer array. Further, a complete megasonic cleaning apparatus includes many other components such as the plumbing for introducing and removing cleaning solutions, and electrical control components for programming and controlling the various wash and rinse operations. Additional information about such a system may be obtained from Verteq, Inc. of Anaheim, Calif., a manufacturer of such equipment.

Referring to FIGS. 2–6, the transducer array 12 includes an elongated, rectangular supporting frame 22 having a pair of elongated side portions 24, a pair of shorter end portions 26, and a central supporting rib 28 that extends parallel to the end portions 26. These portions, together with the rib, define a pair of elongated, rectangular openings 30 and 32. The inner walls of the side and end portions 26 and 28 are formed with a recess 34 that extends completely around the interior perimeter of the windows 30 and 32. The upper surface of the central rib 28 is flush with the recess.

An elongated, rectangular transducer plate 36 is positioned on the frame 22 with its edges precisely fitting within the recessed area so that the transducer plate is firmly and positively supported by the frame 22. The transducer plate is securely maintained in this position by a suitable epoxy applied to the frame recessed area and the upper surface of the rib 28. As indicated in FIG. 5, some epoxy 38 may be applied to the joint corner formed by the lower surface of the transducer plate 36 and the surrounding side wall portions 24 of the frame.

Attached to the lower surface of the transducer plate is a pair of flat, elongated transducers 42 and 44, one of which is centrally positioned in the elongated opening 32 and the other of which is centrally positioned in the opening 30. These transducers are bonded to the plate 36 by a suitable epoxy. Each transducer includes a main body 46 which is in the form of a polarized piezoelectric ceramic material with an electrically conductive coating 48 on its lower surface and an electrically conductive coating 50 on its upper surface. The coating on the upper surface extends onto one end 51 of the transducer which is positioned adjacent to the rib 28. The coating 48 terminates a short distance from that end of the transducer, as may be seen in FIG. 4, so that the electrode coatings are suitably spaced from each other.

An electrical conductor 54 is welded or otherwise suitably connected to the lower electrode, and the other conductor 58 is welded or otherwise suitably connected to the portion of the upper electrode which is conveniently accessible on the end of the transducer. These conductors are connected to an electrical component 60 shown schematically in FIGS. 3 and 5, with such component in turn being connected to the balance of the apparatus for providing a suitable supply (not shown) of megasonic energy.

In accordance with the invention, the transducer is preferably made of polished quartz for use with most cleaning solutions. A few solutions cannot be used with quartz, such as one containing hydrofluoric acid which will etch quartz. Another desirable material is sapphire which is suitable for either acidic or non-acidic solutions. Since it is more expensive than quartz, it is more practical to use sapphire only for that apparatus in which solutions are to be used which are incompatible with quartz. The plate 36 may also be made of other materials having characteristics similar to quartz or sapphire. Another example of a suitable material is boron nitride.

A primary requirement of the plate material is that it must have the necessary characteristics to efficiently and uniformly transmit the megasonic energy. Further, the material must be available in a form to have a smooth surface so as to be easily bonded to the transducer with a uniform layer of bonding material and without the tendency to develop hot spots. Since both quartz and sapphire are dielectric, a conductive epoxy is not required, which is good in that bonding is easier with a non-conductive epoxy. On the other hand, a thermally conductive bonding material is desirable to help dissipate heat away from the transducer so as to minimize the possibility of bubbles expanding in the bonding layer.

Another requirement is that the plate material be relatively strong and durable mechanically so that it can withstand usage over many years and does not mechanically erode as a result of the mechanical vibration. A homogeneous molecular structure with molecular elasticity is desired. Related to this, the material must also be able to withstand temperature variations without mechanical failure.

Also related to the mechanical strength is the thickness of the plate, which in turn is related to he vibrational characteristics of the material. With some materials, such as tantalum, the desired vibrational characteristics for transmitting megasonic energy are only obtained with thin layers, and this in turn introduces the strength aspects.

Naturally, the material must be such that it does not contaminate the cleaning solutions employed. Conversely, it must be able to withstand the cleaning solutions.

Plain glass for the plate is satisfactory as a transmitter of the megasonic energy in situations in which chemical contamination is not critical, such as cleaning glass masks, ceramic substrates or some computer discs. On the other hand, glass is not satisfactory for high purity situations, such as in cleaning semiconductors. Silicon may also be acceptable for some applications, but in the past, it has not been practical to obtain an acceptable silicon plate of the desired size. As noted above, the electrical energy applied to the transducer array must be matched with the materials employed and the thickness of the plate. For a quartz plate of about 0.080 inch with two transducers bonded thereto, each having an upper surface area of about 6 square inches, satisfactory results have been obtained with a 400 watt beam of RF energy at 850–950 kHz. It is believed that with a quartz plate, satisfactory results can be obtained with thickness ranging from 0.030 to 0.300 inch with megasonic energy ranging from 3000 kHz to 300 kHz, the higher frequency being used with the thinner material. For the sapphire plate, a similar thickness range is acceptable with 1000 kHz energy, with a 0.060 inch thick plate being preferable.

The actual wattage is related to the size of the plate. Watt density is a more plate. Watt density is a more, density range of 20 to 40 w/in$^2$ being satisfactory, and 25 being most preferably. A watt density of 40 w/n$^2$ may require cooling on the lower side of the plate to prevent hot spots from forming.

As mentioned, the thickness of the plate used is related to its resonant frequency with the megasonic energy employed. Since more than one transducer is preferably used in an array and the transducers seldom have perfectly matched resonant frequencies, it is necessary to adjust the frequency to best balance the characteristics of the plate and the transducers. Thus, the frequency employed is not necessarily the precise resonant frequency, or fraction or multiple thereof, for the plate. Instead, tuning or adjusting is employed to attain the operating point at which the maximum energy transfer is obtained.

With a system planned for production, two 1-inch by 6-inch flat transducers are employed, mounted in spaced end-to-end relation on a plate about 1.75 inches wide and almost 14 inches in length. Of course, a wide variety of plate shapes and sizes may be employed consistent with thickness, strength and ability to efficiently transmit megasonic energy.

What is claimed is:

1. Megasonic cleaning apparatus, comprising:

a container for receiving a cleaning solution and articles to be cleaned in the solution;

a transducer array mounted in an opening in a wall of the container to transmit megasonic energy into the container directed at the articles to be cleaned so as to loosen particles on the surfaces of such articles, said transducer array including a rigid plate having an interior surface exposed to the interior of the container, and a smooth, flat exterior surface not so exposed, and one or more spaced transducers having a flat, smooth surface bonded to said plate flat surface, said transducers being adapted to oscillate at a frequency for propagating a beam of megasonic energy into said container, said plate being of a material and of a desired thickness that will cause the plate to efficiently transmit said energy into said container, said plate being of sufficient thickness that it can support said transducer and withstand the weight of the material in the container and the mechanical vibrations produced by the megasonic energy, said plate material being hard, durable and relatively inert so as to be able to withstand exposure to cleaning solutions in said container without contaminating the solution, said transducer having an electrically conductive layer on said transducer flat face and having an electrically conductive layer on the surface of said transducer opposite from said flat face wherein said plate material is made of quartz or sapphire or boron nitride; and means connecting said conductive surfaces to a source of megasonic energy for oscillating the transducer.

2. The apparatus of claim 1, including a support positioned in a wall of said container with an opening in said support, said plate extending over said opening with the edges of the plate secured to said support in a fluid sealed manner.

3. The apparatus of claim 2, wherein said support has a surface exposed to the interior of the container with a recess formed therein around the periphery of said opening, and said plate is positioned in said recess and bonded to the support in the area of said recess, said transducer bonded to the exterior of said plate is positioned within said opening but spaced from the surrounding support.

4. The apparatus of claim 3, wherein said plate has an elongated rectangular configuration, said support has a pair of said openings, each of them having an elongated rectangular shape, and said plate extends over both of said openings, said transducer is positioned in one of said openings, and a second transducer bonded to said plate is positioned in the other said openings.

5. The apparatus of claim 4, including a rib in said support separating said opening into two portions, an edge on said rib facing the interior of the container being at the level of said recess, such that said plate is supported on said recess and said rib.

6. The apparatus of claim 1, wherein said electrical coating on said transducer flat face extends onto one end of said transducer, and the electrical coating on the other face of said transducer terminates spaced from said transducer end, said electrical connections including a conductor connected to the conductive layer on said transducer end, and a conductor connected to said other conductive layer.

7. The apparatus of claim 1, wherein said plate is made of quartz and is about 0.080 inch thick.

8. The apparatus of claim 1, wherein said plate is made of sapphire and is about 0.060 inch thick.

9. The apparatus of claim 1, wherein said plate thickness is in a range of about 0.030 to 0.300 inch.

10. A transducer array for use in a megasonic cleaning system, comprising:

an elongated flat plate; and an elongated flat transducer adapted to oscillate so as to propagate a beam of megasonic energy along a predetermined direction, said transducer having an electrically conductive coating on each of its two large flat surfaces, a layer of bonding material bonding said transducer to a flat surface of said plate, said plate being of a thickness and being of a chemically inert dielectric material that will resonate with said transducer to efficiently transmit the oscillations of said transducer, said plate being sufficiently thick and sufficiently sturdy to be self-supporting when supported around its edges and to form a portion of the bottom wall of a container for liquid in cleaning apparatus wherein said plate is made of quartz or sapphire or boron nitride.

11. A transducer array for use in a megasonic cleaning system, comprising:

a flat plate made of quartz or sapphire or boron nitride; and a transducer having a conductive flat surface bonded to said flat plate and a conductive surface spaced from said flat surface, said transducer and said plate being adapted to oscillate to propagate a beam of megasonic energy applied to said conductive surfaces.

12. The array of claim 11, wherein the dimensions of said plate coordinate with the characteristics of said transducer and the energy applied to attain an operating point at which the energy transformed into said beam is optimized.

* * * * *